US007559827B2

(12) United States Patent
Saito

(10) Patent No.: US 7,559,827 B2
(45) Date of Patent: Jul. 14, 2009

(54) DRESSER AND APPARATUS FOR CHEMICAL MECHANICAL POLISHING AND METHOD OF DRESSING POLISHING PAD

(75) Inventor: Toshiya Saito, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 0 days.

(21) Appl. No.: 12/051,965

(22) Filed: Mar. 20, 2008

(65) Prior Publication Data

US 2008/0233842 A1 Sep. 25, 2008

(30) Foreign Application Priority Data

Mar. 23, 2007 (JP) ..... 2007-076874

(51) Int. Cl.
*B24B 1/00* (2006.01)

(52) U.S. Cl. ..... 451/56; 451/443

(58) Field of Classification Search ..... 451/56, 451/443, 285, 287

See application file for complete search history.

(56) References Cited

U.S. PATENT DOCUMENTS 6,729,943 B2 * 5/2004 Kistler et al. ..... 451/286
7,066,795 B2 * 6/2006 Balagani et al. ..... 451/285
7,261,621 B2 * 8/2007 Moon et al. ..... 451/287
2003/0114094 A1 * 6/2003 Myoung et al. ..... 451/443
2004/0048557 A1 * 3/2004 Nabeya ..... 451/56
2004/0110453 A1 * 6/2004 Barnett, III ..... 451/56
2006/0079160 A1 * 4/2006 Balagani et al. ..... 451/285

FOREIGN PATENT DOCUMENTS

JP 2003-039322 * 2/2003

* cited by examiner

*Primary Examiner*—Eileen P. Morgan
(74) *Attorney, Agent, or Firm*—Young & Thompson

(57) ABSTRACT

A dresser adapted to a chemical mechanical polishing apparatus is used to perform dressing on a polishing pad for polishing a semiconductor wafer such that a circular-shaped support surface thereof is positioned opposite to and in contact with the polishing surface of the polishing pad. In the dresser, at least three polish retainers having band-like shapes are formed and elongated in radial directions from substantially the center of the support surface so as to form a plurality of sectorial regions. A plurality of parallel portions are formed in parallel with the polish retainer in each sectorial region. A plurality of band-shaped non-polish retainers are formed between the polish retainer and its parallel portion in each sectorial region. The dresser ensures adequate fuzziness of the polishing pad by way of dressing; hence, it is possible to maintain desired polishing performance of the polishing pad for a long time.

20 Claims, 7 Drawing Sheets

DRESSER AND APPARATUS FOR CHEMICAL MECHANICAL POLISHING AND METHOD OF DRESSING POLISHING PAD

BACKGROUND OF THE INVENTION

1. Field of the Invention

The present invention relates to dressers and apparatuses for chemical mechanical polishing (CMP). The present invention also relates to methods of dressing polishing pads so as to improve fuzziness and to improve maintenance of slurry.

The present application claims priority on Japanese Patent Application No. 2007-76874, the content of which is incorporated herein by reference.

2. Description of the Related Art

As semiconductor manufacturing apparatuses for manufacturing semiconductor wafers, chemical mechanical polishing (CMP) apparatuses have been used to polish membranes (or films) such as interlayer insulating films and metal films formed on the surfaces of semiconductor wafers.

Chemical mechanical polishing apparatuses perform polishing by removing films in such a way that chemical bonding (or chemical reaction) is caused between slurry (i.e., polishing liquid including polishing agents) and films while mechanical loads are applied therebetween. They have been frequently used to realize planation of polished films. That is, chemical mechanical polishing apparatuses perform chemical reaction and mechanical polishing so as to polish films formed on the surfaces of wafers, thus realizing planation of films.

The aforementioned chemical mechanical apparatus is used to polish a semiconductor wafer by use of a polishing pad composed of polyurethane having a desired coefficient of elasticity, a desired fiber form, and a desired shape pattern. In order to maintain stable processiblity in chemical mechanical polishing, it is necessary to periodically modify surfaces of polishing pads. Dressers are used simultaneously with chemical mechanical polishing or are periodically used to remove depleted layers on the surfaces of polishing clothes so as to maintain appropriate surface conditions. Conventionally-known dressers are designed such that diamond particles are attached to base materials.

Patent Document 1: Japanese Unexamined Patent Application Publication No. 2003-39322.

Patent Document 1 teaches a dresser (or a modifying tool) for modifying a polishing pad, in which diamond particles are attached to the surface of a metal base via binders.

FIG. 8 is a bottom view diagrammatically showing the dresser disclosed in Patent Document 1. A dresser 201 shown in FIG. 8 is basically constituted of a metal base 202 having a disk-like shape composed of a stainless steel and a polish retainer 203 arranged in the periphery of the metal base 202. The polish retainer 203 is formed in a circular shape lying along the periphery of the metal base 202. The metal base 202 is constituted of a center portion 202*a* and a non-polish retainer 204 corresponding to a plurality of radial portions 202*b*, which are elongated from the center portion 202*a* in a radial manner; hence, the polish retainer 203 is divided into a plurality of blocks by the radial portions 202*b* forming the non-polish retainer 204. Divided blocks of the polish retainer 203 (referred to as polish blocks 203*a*) are each formed using a binder composed of nickel plating formed on the surface of the metal base 202 and diamond particles attached to the binder.

FIG. 9 is an illustration diagrammatically showing a surface condition of a polishing pad 301 before dressing. As shown in FIG. 9, the polishing pad 301 has a polishing surface 301*a*, which is composed of foam polyurethane. Due to previous dressing, fuzzes K are formed on the polishing surface 301*a*. Foams of polyurethane are opened at various positions of the polishing surface 301*a*, wherein foams are filled with residuals N such as polishing agents and polished residuals.

The dresser 201 shown in FIG. 8 is used to remove a depleted layer of the polishing pad 301 such that a dressing-complete surface (indicated by a dotted line in FIG. 9) is exposed; thus, a new polishing surface 301*b* appears in the polishing pad 301 as shown in FIG. 10, wherein new fuzzes K are formed, and foams H composed of form polyurethane are newly opened on the polishing surface 301*b*. The newly formed fuzzes K of the polishing surface 301*b* may correspond to polished residuals, which are formed when the foam polyurethane is polished using the dresser 201 and which remain not having been removed from the polishing pad 301. By increasing the amount of fuzzes K remaining in the polishing pad 301, it is possible to increase the maintenance of a slurry supplied onto the polishing pad 301 in chemical mechanical polishing.

As described above, a polishing rate of chemical mechanical polishing depends upon the surface condition (or fuzziness) of a polishing pad. That is, as the fuzziness becomes high on the polishing surface, the maintenance of slurry increases so as to increase the polishing rate. The maintenance of a slurry becomes high as the fuzziness of the polishing surface after dressing becomes high and as the fuzziness is oriented in random directions. On the other hand, when a depression force of a dresser applied to a polishing pad (hereinafter, referred to a dresser depression) becomes very high, fuzzes are depressed and crushed so as to cause a reverse effect.

In the conventionally-known dresser 201 shown in FIG. 8, the polish retainer 203, which is a fixed area retaining diamond particles, is divided into the polish blocks 203*a* so that dresser depression must be normally applied to the polishing pad 301; hence, it suffers from a problem in that the Fuzzes K are easily crushed on the polishing pad 301.

There is another problem in that, due to the continuous use of the dresser 201, edges of the polish retainer 203 retaining diamond particles may be gradually degraded, thereby reducing the cutting ability of the polishing pad 301. In this case, it may be possible to slightly improve the cutting ability of the polishing pad 301 by increasing the dresser depression. On the other hand, a tradeoff relationship may be established between increasing the dresser depression and maintaining the fuzziness. That is, it is very difficult to improve both the fuzziness and the polishing ability. As a result, it is very difficult to maintain an adequate cutting ability of the polishing pad 301 for a long time.

SUMMARY OF THE INVENTION

It is an object of the present invention to provide a dresser and an apparatus for chemical mechanical polishing, which ensure adequate fuzziness irrespective of dressing and which maintains an adequate polishing ability with respect to a polishing pad.

It is another object of the present invention to provide a method of dressing the polishing pad for use in the chemical mechanical polishing.

In a first aspect of the present invention, a dresser, which is adapted to a chemical mechanical polishing apparatus so as to perform dressing on a polishing pad, includes a support surface having a circular shape, which is positioned opposite to and in contact with the polishing pad, at least three polish retainers having band-like shapes, which are formed on the support surface and which are elongated from the center of the support surface in radial directions respectively, a plurality of parallel portions, which are formed in a sectorial region defined between the polish retainers adjoining together and which are arranged in parallel with one of the polish retainers, and a plurality of non-polish retainers having band-like shapes, which are formed between either the polish retainers or the plurality of parallel portions.

In the above, it is preferable that the parallel portions are sequentially shortened in the lengths thereof as they depart from one of the polish retainers.

It is preferable that the polish retainers adjoining together are formed to cross each other with a prescribed angle therebetween on the support surface.

It is preferable that the polish retainers and the parallel portions are each formed using a binder layer formed on the support surface and a plurality of polish particles retained in the binder layer.

In a second aspect of the present invention, a chemical mechanical polishing apparatus uses the aforementioned dresser to perform dressing on the polishing pad.

In a third aspect of the present invention, a method of dressing the polishing pad is realized by the use of the aforementioned dresser adapted to a chemical mechanical polishing apparatus.

The present invention provides the following effects.

The support surface (or bottom) of the dresser is divided into a plurality of sectorial regions defined between the polish retainers adjoining together, wherein one polish retainer and its parallel portions are formed in parallel with each other in each sectorial region. Herein, the parallel portions are not formed in radial directions of the support surface having a circular shape, wherein a prescribed distance is maintained constantly between the parallel portions whose distances are not broadened in a radial manner. This makes it possible to secure a desired polishing rate uniformly on the overall area of the support surface of the dresser.

Since the prescribed distance is constantly maintained between the parallel portions lying in parallel with the polish retainer, it is possible to form the non-polish retainers having band-like shapes with equal spacing therebetween. When the dresser rotates while the support surface thereof is brought into contact with the polishing surface of the polishing pad, the polish retainers and parallel portions and the non-polish retainers alternately slide on the polishing surface of the polishing pad, wherein depression forces are not normally applied to fuzzes formed on the polishing surface by the polish retainers and parallel portions, while they are reduced when the non-polish retainers come in contact with the polishing surface. This prevents fuzzes of the polishing pad from being divided from or crushed on the polishing surface; hence, it is possible to increase fuzziness of the polishing pad. Herein, fuzzes correspond to cutting residuals that are not separated from the polishing pad so as to still remain on the polishing surface.

The parallel portions lying in parallel with one polish retainer in one sectorial region are not formed in parallel with other parallel portions lying in parallel with another polish retainer in another sectorial region. Hence, by rotating the dresser in contact with the polishing surface of the polishing pad, it is possible to orientate alignment of fuzziness in random directions.

The polishing pad already subjected to dressing using the dresser increases fuzziness on the polishing surface thereof, wherein alignment of fuzziness is oriented in random directions; hence, it is possible to improve maintenance of slurry maintained in the polishing pad.

No limitation is applied to the rotation directions of the dresser, which can rotate in a clockwise direction or a counterclockwise direction. This makes it possible to avoid the occurrence of partial abrasion on edges of polish particles retained in the polish retainers and parallel portions; hence, it is possible to maintain desired cutting performance of the dresser for a long time.

Since the parallel portions are sequentially shortened in the lengths thereof as they depart from the polish retainer in each sectorial region, it is possible to orient the alignment of fuzzes in random directions, and it is possible to improve the maintenance of slurry maintained in the polishing pad.

The dresser is designed such that the polish retainers are elongated in radial directions from the center of the support surface so as to cross each other with a prescribed angle therebetween, thus forming a plurality of sectorial regions each having substantially the same shape in plan view. This ensures a desired polishing rate uniformly on the overall area of the support surface of the dresser.

Since the polish retainers and parallel portions are each formed using the binder layer and polish particles (retained in the binder layer), they slightly project externally from the support surface by heights corresponding to polish particles, while the non-polish retainers are each recessed compared with them. This reliably reduces depression forces applied to fuzzes of the polishing pad, which come in contact with the non-polish retainers. Thus, it is possible to prevent fuzzes from being separated from the polishing surface; hence, it is possible to increase the fuzziness of the polishing pad.

The chemical mechanical polishing apparatus is equipped with the aforementioned dresser so as to perform dressing on the polishing pad, wherein it is possible to increase the fuzziness of the polishing pad and to orient the alignment of fuzziness in random directions. This improves maintenance of slurry maintained in the polishing pad; thus, it is possible to improve the polishing performance of the polishing pad, which is used to polish a semiconductor wafer.

In the dressing method using the aforementioned dresser, it is possible to increase fuzziness of the polishing pad and to orient alignment of fuzziness in random directions; hence, it is possible to improve the maintenance of slurry maintained in the polishing pad, and it is possible to improve the polishing performance of the polishing pad.

BRIEF DESCRIPTION OF TIE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings.

A preferred embodiment of the present invention will be described with regard to a chemical mechanical polishing apparatus serving as a semiconductor manufacturing apparatus; however, this is not a restriction in the present embodiment.

Figure 1:
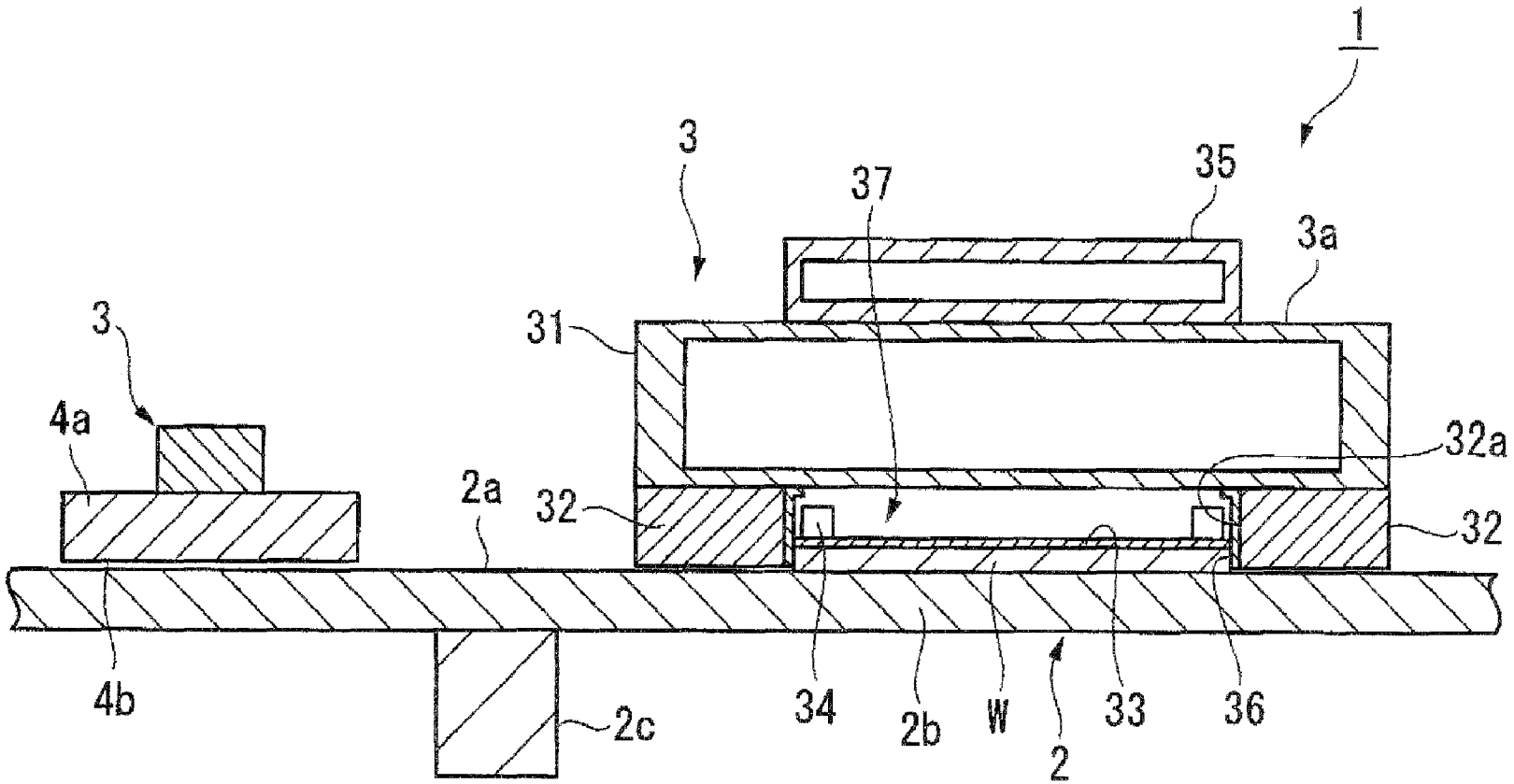
FIG. 1 is a longitudinal sectional view showing the constitution of a chemical mechanical polishing apparatus in accordance with a preferred embodiment of the present invention.
Figure 2:
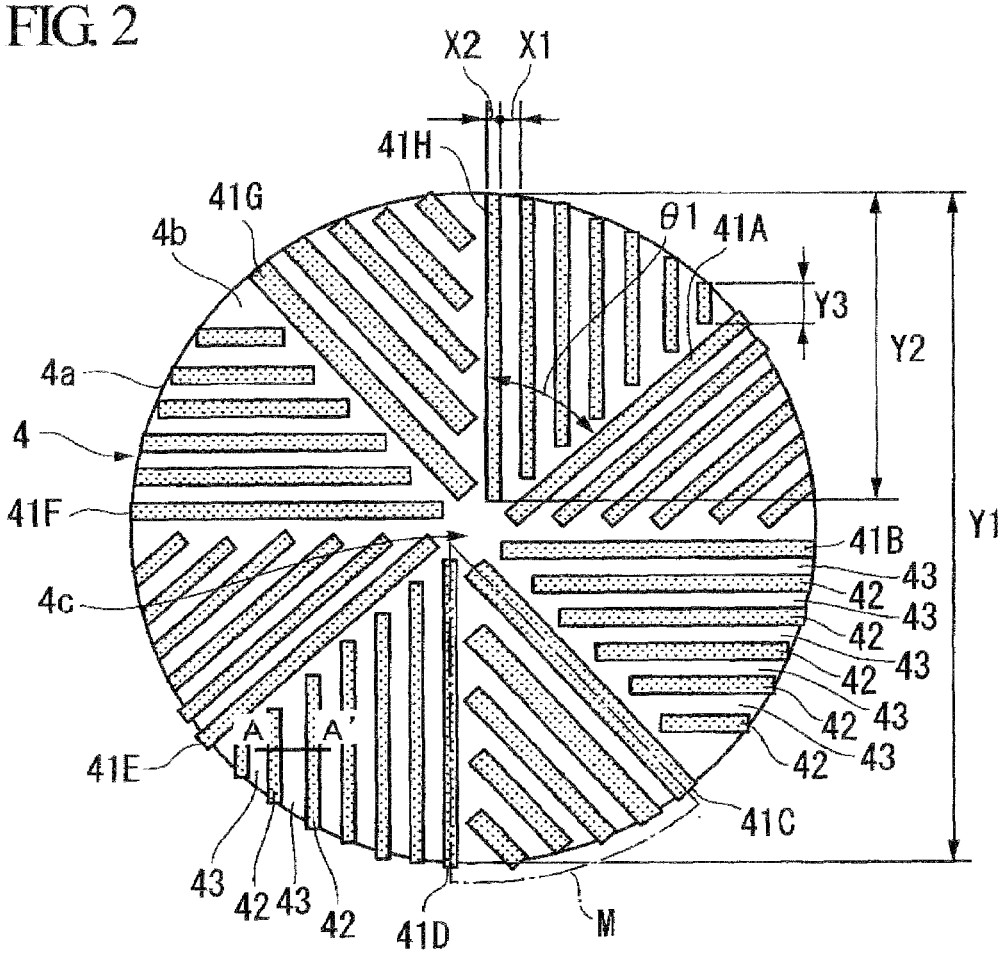
FIG. 2 is a bottom view showing a dresser installed in the chemical mechanical polishing apparatus shown in FIG. 1.
Figure 3:
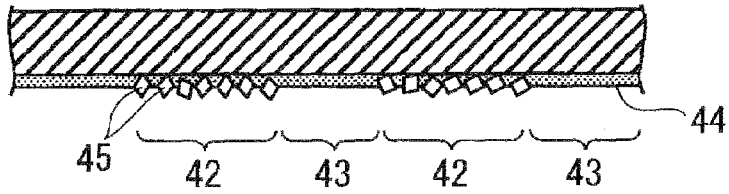
FIG. 3 is a cross-sectional view taken along line A-A in FIG. 2.

FIG. 1 is a longitudinal sectional view showing the constitution of a chemical mechanical polishing (CMP) apparatus 1; FIG. 2 is a bottom view showing a dresser 4 installed in the chemical mechanical polishing apparatus 1; and FIG. 3 is a cross-sectional view taken along line A-A in FIG. 2. FIGS. 1 to 3 are illustrations diagrammatically showing the chemical mechanical polishing apparatus 1 and the dresser 4, wherein sizes, dimensions, and thicknesses of parts do not precisely match accurate values thereof for use in actual productions.

The chemical mechanical polishing apparatus 1 performs planation processing on oxide films such as interlayer insulating films and metal layers such as wirings formed on a semiconductor wafer. The chemical mechanical polishing apparatus 1 includes a polishing pad 2, a wafer holding head 3, and the dresser 4 used for chemical mechanical polishing. The chemical mechanical polishing apparatus 1 is of a type for processing each single semiconductor wafer provided thereto.

The polishing pad 2 is a disk-like member in which a polishing surface 2*a* thereof is composed of polyurethane, wherein a polishing cloth composed of polyurethane is adhered to the surface of a metal disk 2*b*. A rotation shaft 2*c* is attached to the lower portion of the metal disk 2*b*. A rotation drive device (not shown) is interconnected to the rotation shaft 2*c*, so that the polishing pad 2 can rotate about the rotation shaft 2*c* at a rotation speed of 30 rpm by means of the rotation drive device.

A nozzle (not shown) for supplying a slurry onto the polishing surface 2*a* is arranged in proximity to the center of the polishing surface 2*a*. The slurry is composed of a polishing agent (e.g., silica) dispersed in a dispersion solution, wherein it is supplied onto the polishing surface 2*a* at a discharge rate of 300 ml/min, for example. The slurry supplied onto the polishing surface 2*a* of the polishing pad 2 being rotated is spread entirely over the polishing surface 2*a* due to centrifugal force.

Next, the wafer holding head 3 is basically constituted of a head unit 31, a retainer ring 32 attached to the head unit 31 in proximity to the polishing surface 2*a*, a membrane sheet 33 arranged in a through-hole 32*a* of the membrane ring 32, a periphery pressure member 34, which is arranged in the through-hole 32*a* of the retainer ring 32 so as to come in contact with the membrane sheet 33. A semiconductor wafer W subjected to polishing is absorbed and held at a prescribed position under the membrane sheet 33 in proximity to the polishing surface 2*a*.

A connection member 35 for connecting the wafer holding head 3 to a head drive (not shown) is attached to the head unit 31 oppositely to the polishing surface 2*a*. The head drive drives the wafer holding head 3 in contact with the polishing surface 2*a* of the polishing pad 2 so as to rotate at a rotation speed of 29 rpm, for example. Herein, the head drive vibrates the wafer holding head 3 along a radial direction of the polishing pad 2.

The head unit 31 is a metal housing for holding the retainer ring 32 and for depressing the semiconductor wafer W downwardly due to its own weight. The retainer ring 32 is composed of a high polymer material having high chemical resistance and high abrasion resistance such as polyphenylene sulfide or polyetheretherketone.

The membrane sheet 33 composed of neo-plain rubber is attached inside of the through-hole 32*a* of the retainer ring 32 at a prescribed position substantially matching half the thickness of the retainer ring 32. That is, the overall space of the through-hole 32*a* is partitioned into an upper space and a lower space by means of the membrane sheet 33. In the through-hole 32*a* partitioned by the membrane sheet 33, the lower space serves as a holder 36 for holding the semiconductor wafer W in contact with the polishing surface 2*a*, while the upper space serves as a pressure chamber 37 defined between the membrane sheet 33 and the head unit 31. A pipe (not shown) for introducing a high-pressure air (used for pressuring) from an external device (not shown) is interconnected to the pressure chamber 37. This makes it possible to freely adjust the internal pressure of the pressure chamber 37. Since the membrane sheet 33 is composed of an elastic material such as neo-plain rubber, the membrane sheet 33 is depressed downwardly towards the polishing surface 2*a* as the internal pressure of the pressure chamber 37 increases, whereby the membrane sheet 33 depresses the semiconductor wafer W in contact with the polishing surface 2*a*.

The periphery pressure member 34 is mounted on the surface of the membrane sheet 33 in proximity to the pressure chamber 37. The periphery pressure member 34 is a ring-shaped hollow tube composed of a high polymer material and is positioned in conformity with the periphery of the semiconductor wafer W. Similar to the pressure chamber 37, a pipe (not shown) for introducing a high-pressure air (used for pressurizing) from an external device (not shown) is interconnected to the periphery pressure member 34. This makes it possible to freely adjust the internal pressure of the periphery pressure member 34. Since the periphery pressure member 34 is composed of a flexible material such as a high polymer material, the periphery pressure member 34 depresses the periphery of the membrane sheet 33 as the internal pressure of the periphery pressure member 34 increases, whereby due to the depression applied to the periphery of the membrane sheet 33, the periphery of the semiconductor wafer W is depressed downwardly toward the polishing surface 2*a*.

According to the aforementioned structure and mechanism, a depression force is uniformly applied to the overall surface of the semiconductor wafer W held by the wafer holding head 3, so that the semiconductor wafer W is rotated and vibrated on the polishing surface 2*a*. By means of the head drive for driving the wafer holding head 3, a depression force F1 of about 70N is applied entirely to the wafer holding head 3 holding the semiconductor wafer W. In addition, when a high-pressure air is introduced into the pressure chamber 37, the internal pressure of the pressure chamber 37 increases so as to apply a depression force F2 of about 50N substantially to the center portion of the semiconductor wafer W by way of the membrane sheet 33. Furthermore, when high-pressure air is introduced into the periphery pressure member 34, the internal pressure of the periphery pressure member 34 increases so as to apply a depression force F3 of about 50N±5N mainly to the periphery of the semiconductor wafer W. By combining the depression forces F1, F2, and F3, it is possible to apply a desired depression force uniformly to the overall surface of the semiconductor wafer W. Then, slurry is supplied to the polishing surface 2*a* so as to perform chemical mechanical polishing on the semiconductor wafer W.

The polishing rate of the chemical mechanical polishing exerted on the semiconductor wafer W may vary substantially in proportion to the depression force F2; however, the polishing rate may not have plane uniformity and be degraded with respect to the periphery of the semiconductor wafer W. The periphery pressure member 34 is a ring-shaped hollow tube that is positioned on the membrane sheet 33 just above the periphery of the semiconductor wafer W, wherein high-pressure air is introduced into the tube so as to cause the depression force F3, which is adjusted within a range of 50N±5N so as to appropriately depress the periphery of the semiconductor wafer W. This makes it possible to control the depression force applied to the semiconductor wafer W in accordance with a desired plane profile.

The semiconductor wafer W already subjected to chemical mechanical polishing is retained for a predetermined time period and is then washed and collected; thereafter, a subsequent semiconductor wafer is subjected to chemical mechanical polishing. In a time interval for changing semiconductor wafers, the polishing pad 2 is subjected to dressing so as to regenerate the polishing surface 2*a*.

Next, as shown in FIGS. 1 and 2, the dresser 4 installed in the chemical mechanical polishing apparatus 1 is designed such that a plurality of polish retainers are formed on a bottom 4*b* (or a support surface) of a metal base 4*a* having a disk-like shape. The dresser 4 is mounted on the polishing surface 2*a* of the polishing pad 2 in such a way that the bottom 4*b* is directed downwardly. A dresser drive (not shown) is connected to the dresser 4, whereby it rotates the dresser 4 applied with a depression force of about 20N at a rotation speed of 40 rpm, for example. In addition, it also vibrates the dresser 4 along a radial direction of the polishing pad 2.

The bottom 4*b* of the dresser 4 is a circular surface substantially matching the polishing pad 2. Eight polish retainers 41A to 41H having band-like shapes are formed and elongated substantially in radial directions from a center 4*c* of the bottom 4*b* of the dresser 4. In addition, a plurality of parallel portions 42 are formed in parallel with each of the polish retainers 41A to 41H on the bottom 4*b* of the dresser 4. Furthermore, a plurality of non-polish retainers 43 having band-like shape are formed between the parallel portions 42 and the polish retainers 41A to 41H.

As shown in FIG. 3, the polish retainers 41A to 41H and the parallel portions 42 are formed using a binder layer 44 (e.g., a nickel plating layer) and polish particles 45 fixedly attached to the binder layer 44. It is possible to list diamond particles as the polish particles 45, for example. The non-polish retainers 43 are formed using only the binder layer 44 not having the polish particles 45. Due to the fixed attachment of the polish particles 45, the polish retainers 41A to 41H and the parallel portions 42 slightly project from the non-polish retainers 43 toward the polishing surface 2*a* of the polishing pad 2. In the illustration of FIG. 3, the non-polish retainers 43 are formed using only the binder layer 44; but this is not a restriction in the present invention. That is, it is possible to exclude the binder layer 44 in the formation of the non-polish retainers 43.

Next, the positional relationships between the polish retainers 41A to 41H, the parallel portions 42, and the non-polish retainers 43 will be described in detail.

As described above, the polish retainers 41A to 41H are elongated from the center 4*c* of the bottom 4*b* of the dresser 4 "substantially in radial directions". In other words, the polish retainers 41A to 41H may be elongated in longitudinal directions such that they are deviated from the center 4*c* of the bottom 4*b*. This formation cannot be referred to as "radial directions" in strict sense; hence, the aforementioned expression "substantially in radial directions" may embrace a relatively broad range of meaning compared with "strictly in radial directions".

The polish retainers 41A to 41H are formed to mutually cross each other (not in a physical sense) with a prescribed angle θ1 therebetween. In the illustration of FIG. 2, the eight polish retainers 41A to 41H are formed on the bottom 4*b* to mutually cross each other; hence, the prescribed angle θ1 therebetween is set to 45°. That is, the prescribed angle θ1 directly depends upon the number of polish retainers. In the present embodiment, it is preferable to set the angle θ within a range between 30° and 120°; that is, it is preferable to form the polish retainers within a range between three and twelve.

Noticing the polish retainers 41C and 41D adjoined together, between which a sectorial region M is formed. A plurality of parallel portions 42 lie in parallel with the polish retainer 41C in the sectorial region M; and a plurality of non-polish retainers 43 having band-like shapes are formed between the polish retainer 41C and its parallel portions 42.

The parallel portions 42 lying in parallel with the polish retainer 41C are formed ranging from an area proximate to the polish retainer 41D to the peripheral end of the bottom 4*b*. That is, the parallel portions 42 are sequentially shortened in lengths thereof as they are distanced from the polish retainer 41C.

Other sectorial regions similar to the sectorial region between the polish retainers 41C and 41D are formed between adjacent ones of other polish retainers within the polish retainers 41A to 41H. In other sectorial regions, the parallel portions are formed in parallel with other polish retainers and are sequentially shortened in the lengths thereof as they are distanced from other polish retainers. In addition, non-polish retainers 43 having band-like shapes are formed between other polish retainers and the parallel portions 42.

The number of the parallel portions 42 formed in each sectorial region is not necessarily limited. A plurality of sectorial regions are formed on the bottom 4*b* of the dresser 4, wherein a different number of the parallel portions 42 can be formed in each sectorial region. In the actuality, the number of the parallel portions 42 is determined based on a width 52 (applied to each of the polish retainers 41A to 41H and the parallel portions 42) and a width X1 (applied to each of the non-polish retainers 43). The widths X1 and X2 depend upon a diameter Y1 of the bottom 4*b* of the dresser 4, wherein, when the diameter Y1 ranges within 110 mm±5 mm or so, it is preferable that the widths X1 and X2 range from 5 mm to 9 mm, for example. In addition, it is preferable that the width X1 applied to each of the non-polish retainer 43 range from 6 mm to 14 mm. Furthermore, it is preferable that a ratio between X1 and X2 (i.e., X1/X2) range from 1.2 to 1.4. When the ratio X1/X2 exceeds 1.4, a cutting efficiency of the polishing pad 2, which is completed in dressing, decreases. When the ratio X1/X2 is less than 1.2, fuzzes of the polishing pad 2 may be crashed in dressing, thus reducing the maintenance of slurry. It is preferable that a length Y2 (applied to each of the polish retainers 41A to 41H) be in a range of 50 mm±5 mm. It is preferable that a length Y3 (applied to the shortest ones of the parallel portions 42) be in a range of 14 mm±5 mm.

As described above, the parallel portions 42 are formed in parallel with the polish retainers 41A to 41H respectively. This indicates that the parallel portions 42 are arranged not in parallel with radial directions of the bottom 4*b* having a circular shape. This prevents the distances between the parallel portions 42 from being broadened in a radial manner; hence, the distances can be maintained constantly. Thus, it is possible to secure a prescribed polishing rate uniformly on the overall area of the bottom 4*b* of the dresser 4 positioned relative to the polishing surface 2*a*.

Since the distances between the parallel portions 42 are maintained constantly, it is possible to constantly maintain the same distance with respect to the non-polish retainers 43 having band-like shapes. When the dresser 4 rotates in contact with the polishing surface 2*a* of the polishing pad 2, the polish retainers 41A to 41H, the parallel portions 42, and the non-polish retainers 43 alternately slide on the polishing surface 2*a* of the polishing pad 2. Therefore, fuzzes formed on the polishing surface 2*a* of the polishing pad 2 are not normally depressed by the polish retainers 41A to 41H and the parallel portions 42 due to their sliding movements, but depression forces applied to fuzzes are released by the non-polish retainers 43, which come in contact with them. Thus, it is possible to prevent fuzzes of the polishing pad 2 from being cut out or crashed on the polishing surface 2*a*.

As shown in FIG. 2, the parallel portions 42 are not aligned in parallel with each other in adjacent sectorial regions of the bottom 4*b* of the dresser 4; hence, when the dresser 4 rotates in contact with the polishing surface 2*a* of the polishing pad 2, it is possible to orientate the fuzziness of the polishing pad 2 in a random direction.

Figure 4:
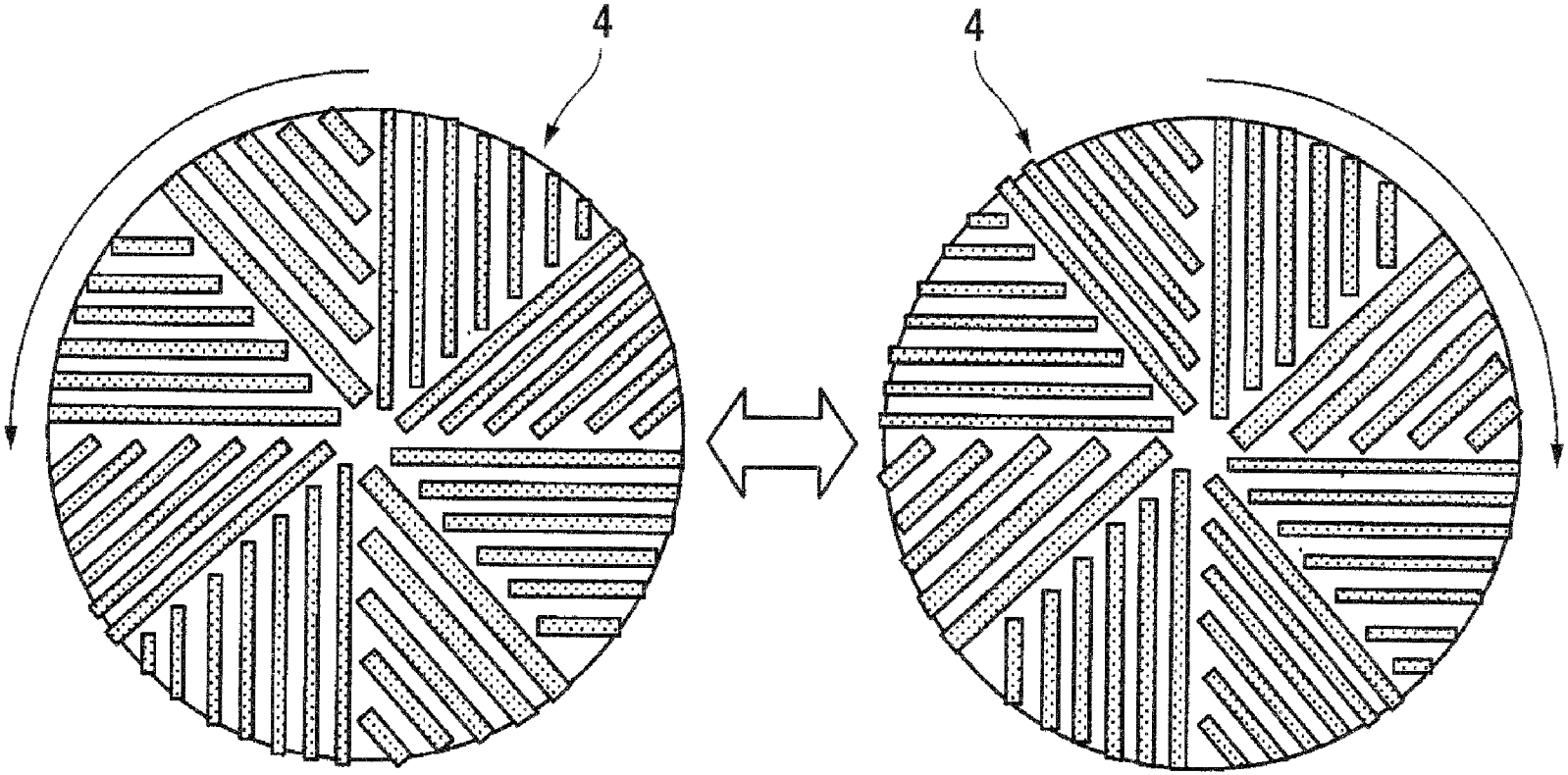
FIG. 4 shows rotation directions in connection with the bottom of the dresser.

Basically, no limitation is applied to the rotation direction of the dresser 4; that is, as shown in FIG. 4, the dresser 4 can be arbitrarily rotated in a clockwise direction or a counter-clockwise direction. This avoids partial abrasion with respect to edges of the polish particles 45 retained in the polish retainers 41A to 41H and the parallel portions 42; hence, it is possible to maintain a desired polishing ability of the dresser 4 for a long time.

Since the parallel portions 42 are sequentially shortened in the lengths thereof as they depart from the polish retainers 41A to 41H, it is possible to orientate the fuzziness of the polishing pad 2 in a random direction.

Since the polish retainers 41A to 41H are elongated from the center 4*c* of the bottom 4*b* of the dresser 4 in radial direction so as to mutually cross each other with the same angle θ1 therebetween, a plurality of sectorial regions each having the same shape are formed on the bottom 4*b* of the dresser 4. Thus, it is possible to secure a prescribed polishing rate uniformly on the dresser 4 positioned relative to the polishing surface 2*a* of the polishing pad 2.

In addition, the polish retainers 41A to 41H and the parallel portions 42, all of which retain the polish particles 45, project from the bottom 4*b* of the dresser 4 towards the polishing pad 2 by certain heights corresponding to the polish particles 45, while the non-polish retainers 43 are recessed compared with them. This reliably reduces depression forces applied to fuzzes of the polishing pad 2, which come in contact with the non-polish retainers 43. Thus, it is possible to prevent fuzzes of the polishing surface 2*a* from being cut out; hence, it is possible to increase the fuzziness of the polishing pad 2.

Next a method of dressing the polishing pad 2 by use of the dresser 4 will be described with reference to FIGS. 5 and 6.

The chemical mechanical polishing apparatus 1 of the present embodiment is for polishing each single semiconductor wafer, wherein a plurality of semiconductor wafers are sequentially supplied thereto and are sequentially subjected to chemical mechanical polishing. The dressing method can be performed in a time interval for changing semiconductor wafers; alternatively, it can be performed simultaneously with chemical mechanical polishing exerted on the semiconductor wafer W.

Figure 5:
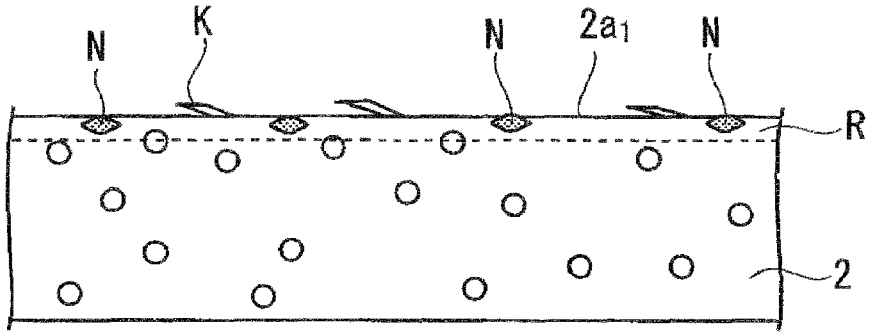
FIG. 5 is an illustration showing the surface condition of the polishing pad before dressing.

FIG. 5 diagrammatically shows the condition of a polishing surface 2*a*1 of the polishing pad 2 before dressing. FIG. 5 shows the condition of the polishing pad 2, which is used to complete chemical mechanical polishing of the semiconductor wafer W, wherein a depleted layer R is not removed and remains on the surface of the polishing pad 2. In FIG. 5, fuzzes K, which are formed by way of a previous dressing work, still remain on the polishing surface 2*a*1 of the polishing pad 2. The fuzzes K are crushed while being depressed by the semiconductor wafer W, to which the polishing pad 2 is pressed. Due to sliding movement of the polishing pad 2 on the semiconductor wafer W, a relatively large number of the fuzzes K are cut out from the polishing surface 2*a*1 and are lost from the polishing pad 2. Foams of foam polyurethane are opened on the polishing surface 2*a*1 and are filled with residuals N such as polishing agents and polished residuals.

Dressing is performed on the polishing pad 2 shown in FIG. 5 by use of the dresser 4 shown in FIG. 2 so as to remove the depleted layer R such that a dressing-complete surface indicated by a dotted line is exposed.

For example, the polishing pad 2 is rotated at a rotation speed of 30 rpm, while a depression force of 20N is applied to the dresser 4, which is driven to rotate at a rotation speed 40 rpm and to vibrate in a radial direction of the polishing pad 2.

Figure 6:
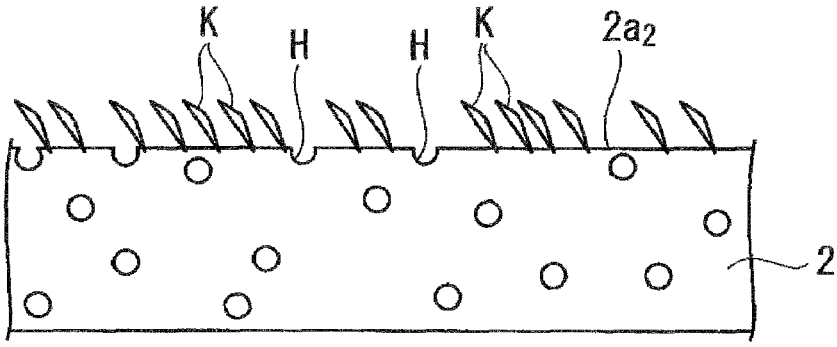
FIG. 6 is an illustration showing the surface condition of the polishing pad subjected to dressing using the dresser.

By way of the aforementioned dressing, it is possible to form a new polishing surface 2*a*2 in the polishing pad 2 as shown in FIG. 6. New fuzzes K are formed on the polishing surface 2*a*2 of the polishing pad 2, on which foams H of the foam polyurethane are newly opened. The new fuzzes K are substantially disposed on the polishing surface 2*a*2 without being crushed, wherein they are disposed in a random direction, and the total number of the fuzzes is remarkably increased in comparison with the conventionally-known dressing method.

As described above, it is possible to increase the fuzziness of the polishing surface 2*a* of the polishing pad 2 due to the dressing using the dresser 4, and the fuzziness occurs in random directions; hence, it is possible to improve the maintenance of slurry maintained in the polishing pad 2.

The chemical mechanical polishing apparatus 1 is designed to perform dressing on the polishing pad 2 by use of the dresser 4; this increases the fuzziness of the polishing surface 2*a*, wherein the fuzziness occurs in random directions. Thus, it is possible to improve the maintenance of slurry maintained in the polishing pad 2, and it is possible to improve the polishing ability for a polished subject (e.g., the semiconductor wafer W).

Figure 7:
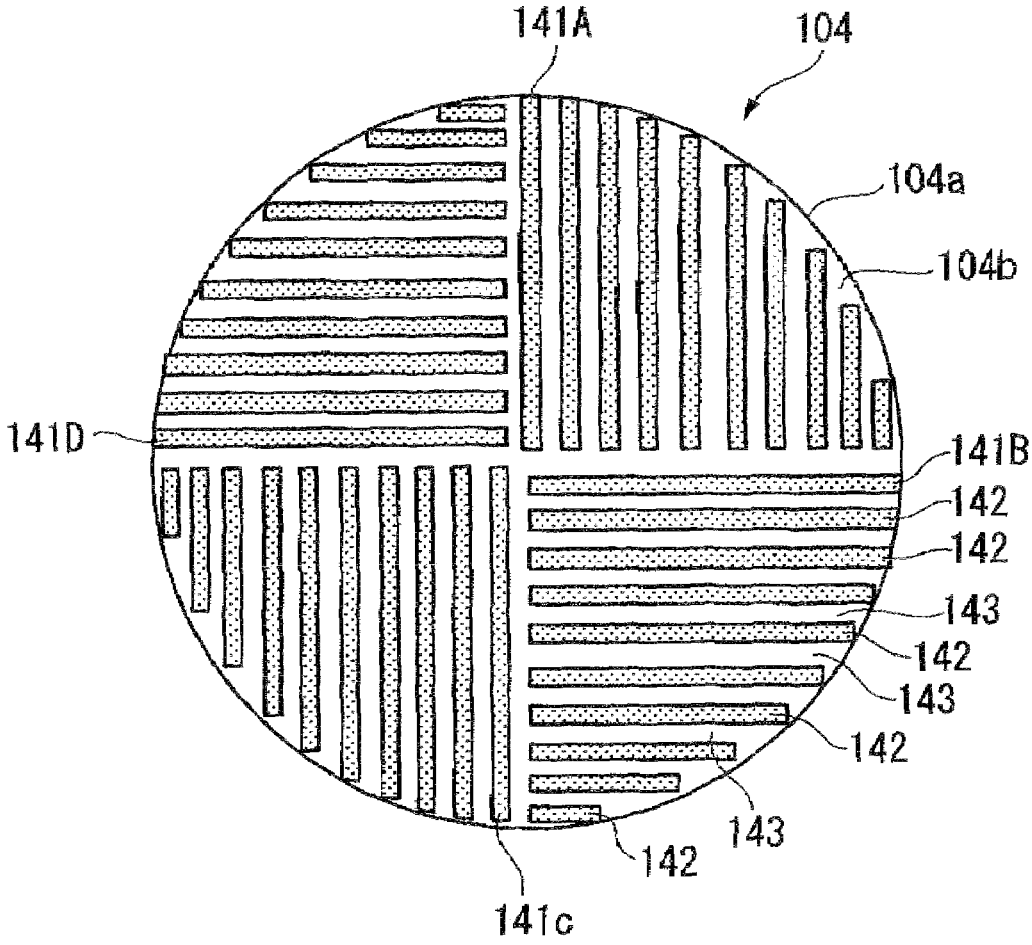
FIG. 7 is a bottom view showing a modified example with regard to the bottom of the dresser.
Figure 8:
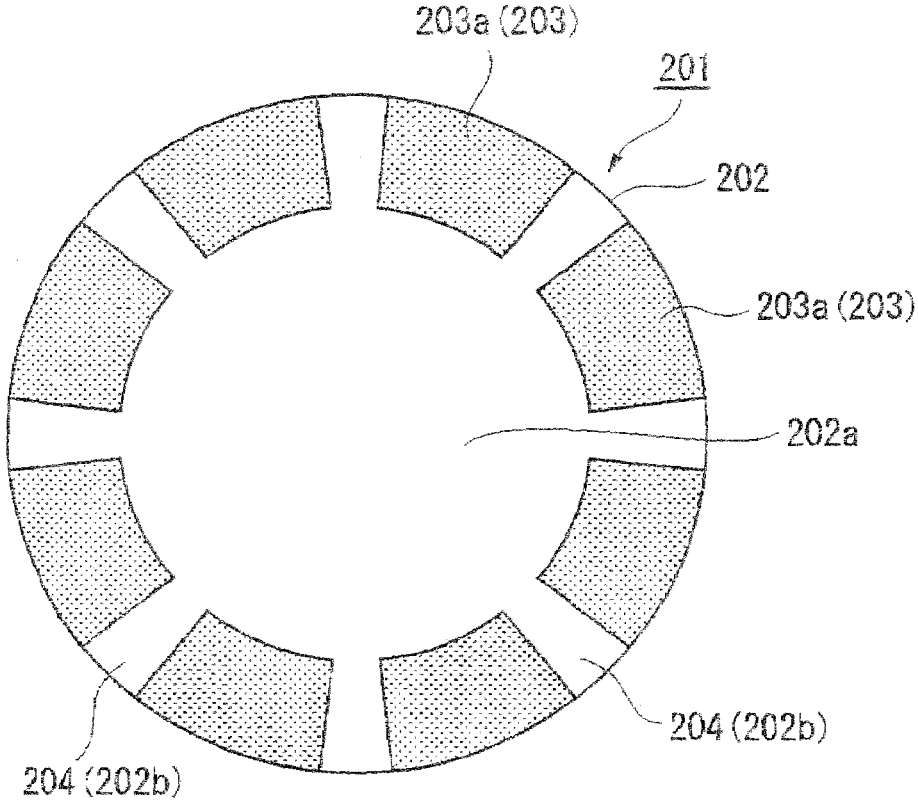
FIG. 8 (PRIOR ART)
FIG. 8 is bottom view showing a conventional example of a dresser for use in chemical mechanical polishing.
Figure 9:
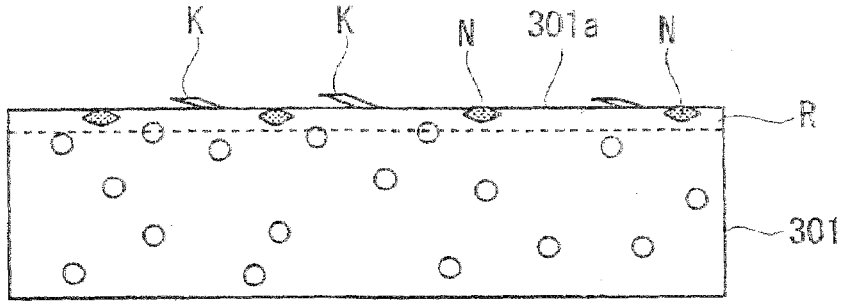
FIG. 9 (PRIOR ART)
FIG. 9 is an illustration diagrammatically showing the surface condition of a polishing pad before dressing using the dresser shown in FIG. 8.
Figure 10:
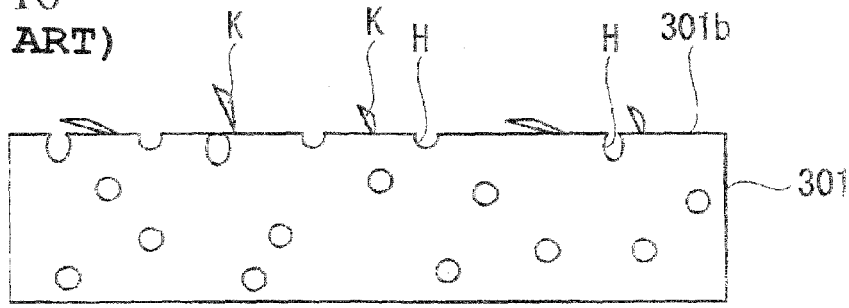
FIG. 10 (PRIOR ART)
FIG. 10 is an illustration diagrammatically showing the surface condition of the polishing pad after dressing using the dresser shown in FIG. 8.

The present invention is not necessarily limited to the present embodiment; hence, it is possible to provide a variety of modifications without departing from the scope of the invention. For example, the dresser 4 shown in FIG. 2 can be modified in the form of a dresser 104 shown in FIG. 7.

In the dresser 104 designed similar to the dresser 4, a plurality of polish retainers are formed on a bottom 104*b* (or a support surface) of a metal base 104*a* having a disk-like shape. Specifically, four polish retainers 141A to 141D having band-like shapes are formed on the bottom 104*b* of the dresser 104 and are elongated in radial directions. In addition, a plurality of parallel portions 142 are formed in parallel with the polish retainers 141A to 141D. Furthermore, a plurality of non-polish retainers 143 having band-like shapes are formed between the polish retainers 141A to 141D and the parallel portions 142. Similar to the dresser 4, the polish retainers 141A to 141D and the parallel portions 142 are formed using a binder layer and polish particles (not shown). The non-polish retainers 143 are formed using the binder layer. Since the four polish retainers 141A to 141D are formed on the bottom 104*b* of the dresser 104, they mutually cross each other by an angle of 90° therebetween.

Other parts of the dresser 104 are basically identical to those of the dresser 4; hence, the duplicate description thereof is omitted.

Similar to the aforementioned dressing using the dresser 4, it is possible to increase the fuzziness of the polishing surface of a polishing pad (not shown) subjected to dressing using the dresser 104, wherein the fuzziness is orientated in random directions; hence, it is possible to remarkably improve the maintenance of slurry maintained in the polishing pad.

Lastly, the present invention is not necessarily limited to the present embodiment, which can be further modified in a variety of ways within the scope of the invention as defined in the appended claims.

What is claimed is:

1. A dresser adapted to a chemical mechanical polishing apparatus so as to perform dressing on a polishing pad, comprising:

a support surface having a circular shape, which is positioned opposite to and in contact with the polishing pad;

at least three polish retainers having band-like shapes, which are formed on the support surface and which are elongated from substantially the center of the support surface in respective radial directions;

a plurality of parallel portions, which are formed in a sectorial region defined between two adjacent polish retainers and which are arranged in parallel with one of the two adjacent polish retainers; and a plurality of non-polish retainers having band-like shapes, which are formed between one of the two adjacent polish retainers and the plurality of parallel portions.

2. The dresser adapted to a chemical mechanical polishing apparatus according to claim 1, wherein the plurality of parallel portions are sequentially shortened in the lengths thereof in a departing direction from one of the two adjacent polish retainers.

3. The dresser adapted to a chemical mechanical polishing apparatus according to claim 2, wherein the polish retainers and the parallel portions are each formed using a binder layer formed on the support surface and a plurality of polish particles retained in the binder layer.

4. The dresser adapted to a chemical mechanical polishing apparatus according to claim 1, wherein the two adjacent polish retainers are arranged with a predetermined angle therebetween on the support surface.

5. The dresser adapted to a chemical mechanical polishing apparatus according to claim 4, wherein the polish retainers and the parallel portions are each formed using a binder layer formed on the support surface and a plurality of polish particles retained in the binder layer.

6. The dresser adapted to a chemical mechanical polishing apparatus according to claim 4, wherein the predetermined angle is in the range of 30° to 120°.

7. The dresser adapted to a chemical mechanical polishing apparatus according to claim 6, wherein the predetermined angle is 45°.

8. The dresser adapted to a chemical mechanical polishing apparatus according to claim 1, wherein the polish retainers and the parallel portions are each formed using a binder layer formed on the support surface and a plurality of polish particles retained in the binder layer.

9. A chemical mechanical polishing apparatus including a dresser for dressing a polishing pad, said dresser including:

a support surface having a circular shape, which is positioned opposite to and in contact with the polishing pad;

at least three polish retainers having band-like shapes, which are formed on the support surface and which are elongated from substantially the center of the support surface in respective radial directions;

a plurality of parallel portions, which are formed in a sectorial region defined between two adjacent polish retainers and which are arranged in parallel with one of the two adjacent polish retainers; and a plurality of non-polish retainers having band-like shapes, which are formed between one of the two adjacent polish retainers and the plurality of parallel portions.

10. A chemical mechanical polishing apparatus according to claim 9, wherein the plurality of parallel portions are sequentially shortened in the lengths thereof in a departing direction from one of the two adjacent polish retainers.

11. A chemical mechanical polishing apparatus according to claim 10, wherein the polish retainers and the parallel portions are each formed using a binder layer formed on the support surface and a plurality of polish particles retained in the binder layer.

12. A chemical mechanical polishing apparatus according to claim 9, wherein the two adjacent polish retainers are arranged with a predetermined angle therebetween on the support surface.

13. A chemical mechanical polishing apparatus according to claim 12, wherein the polish retainers and the parallel portions are each formed using a binder layer formed on the support surface and a plurality of polish particles retained in the binder layer.

14. A chemical mechanical polishing apparatus according to claim 9, wherein the polish retainers and the parallel portions are each formed using a binder layer formed on the support surface and a plurality of polish particles retained in the binder layer.

15. A method of dressing a polishing pad by use of a dresser adapted to a chemical mechanical polishing apparatus, the method comprising dressing a polishing pad with a dresser including:

a support surface having a circular shape, which is positioned opposite to and in contact with the polishing pad;

at least three polish retainers having band-like shapes, which are formed on the support surface and which are elongated from substantially the center of the support surface in respective radial directions;

a plurality of parallel portions, which are formed in a sectorial region defined between two adjacent polish retainers and which are arranged in parallel with one of the two adjacent polish retainers; and a plurality of non-polish retainers having band-like shapes, which are formed between one of the two adjacent polish retainers and the plurality of parallel portions.

16. The method of dressing a polishing pad according to claim 15, wherein the plurality of parallel portions are sequentially shortened in the lengths thereof in a departing direction from one of the two adjacent polish retainers.

17. The method of dressing a polishing pad according to claim 16, wherein the polish retainers and the parallel portions are each formed using a binder layer formed on the support surface and a plurality of polish particles retained in the binder layer.

18. The method of dressing a polishing pad according to claim 15, wherein the two adjacent polish retainers are arranged with a predetermined angle therebetween on the support surface.

19. The method of dressing a polishing pad according to claim 18, wherein the polish retainers and the parallel portions are each formed using a binder layer formed on the support surface and a plurality of polish particles retained in the binder layer.

20. The method of dressing a polishing pad according to claim 15, wherein the polish retainers and the parallel portions are each formed using a binder layer formed on the support surface and a plurality of polish particles retained in the binder layer.

* * * * *